US006647630B1

(12) United States Patent
Lucas et al.

(10) Patent No.: US 6,647,630 B1
(45) Date of Patent: Nov. 18, 2003

(54) STUD PUNCH TOOL

(75) Inventors: James H. Lucas, Loves Park, IL (US); William F. Nordlin, Rockford, IL (US)

(73) Assignee: Greenlee Textron Inc., Rockford, IL (US)

( * ) Notice: Subject to any disclaimer, the term of this patent is extended or adjusted under 35 U.S.C. 154(b) by 65 days.

(21) Appl. No.: 09/776,441

(22) Filed: Feb. 2, 2001

(51) Int. Cl.[7] ..... B26F 1/00
(52) U.S. Cl. ..... 30/363; 30/251
(58) Field of Search ..... 30/363, 211, 250, 30/251

(56) References Cited

U.S. PATENT DOCUMENTS 5,560,110 A * 10/1996 Haines ..... 30/363

FOREIGN PATENT DOCUMENTS

DE 637760 * 4/1935

GB 28437 * 12/1909

OTHER PUBLICATIONS

Page 120 of Greenlee Product Catalog, Copyright 1990.

* cited by examiner

*Primary Examiner*—Douglas D. Watts
(74) *Attorney, Agent, or Firm*—Trexler, Bushnell, Giangiorgi, Blackstone & Marr, Ltd.

(57) ABSTRACT

The present invention provides a novel stud punch tool for punching a stud. The tool includes a first member, a second member, a third member pivotally connected to the first and second members, and a punch assembly. The first member has an opening for receiving the stud and a bore that is in communication with the opening and which allows the punch assembly to move through the bore and the opening to punch the stud. The second member has slots therein to allow the punching assembly to be slidably mounted therein such that a portion of the punch assembly is capable of being positioned at a first end of the slot when the second member is parallel to the first member and such that the portion is capable of being positioned at a second end of the slots when the second member is angled from the first member.

13 Claims, 8 Drawing Sheets

22
6
32
38
17
36
30
40
34
46
8
8
68
48
44
62
52
50
64
56
58
60
7
6
42

32
38
22
40
46
64
66

STUD PUNCH TOOL

BACKGROUND OF THE INVENTION

For many years, those working in the plumbing industry have required tools that would allow them to punch holes in steel studs and/or sheet metal to allow them to run plumbing pipe therethrough. The tools that have evolved for this purpose have had some drawbacks. One such drawback is that the hand operated punches have required a large amount of handle force to punch a large hole, i.e., one with a diameter of over two and a half inches. If the required handle force were reduced, the punch was usually not provided with enough travel to allow the punch to clear the stud. Therefore, there is a need in the plumbing industry for a punch tool that is capable of punching holes of a large diameter that requires a relatively low handle force but that also provides enough travel for the punch to clear the stud.

OBJECTS AND SUMMARY OF THE INVENTION

A primary object of the invention is to provide a stud punch tool for the punching of steel studs and/or sheet metal that will allow the plumbing industry to punch holes therein large enough to run two-inch PVC pipe.

Another object of the invention is to provide a stud punch that keeps handle force low to punch a hole while providing enough travel so that the punch can clear a stud to allow the tool to be easily placed on and off of the stud.

Briefly, and in accordance with the foregoing, the present invention provides a novel stud punch tool for punching a stud. The tool includes a first member, a second member, a third member pivotally connected to the first and second members, and a punch assembly. The first member has an opening for receiving the stud and a bore that is in communication with the opening and which allows the punch assembly to move through the bore and the opening to punch the stud. The second member has slots therein to allow the punching assembly to be slidably mounted therein such that a portion of the punch assembly is capable of being positioned at a first end of the slots when the second member is parallel to the first member and such that the portion is capable of being positioned at a second end of the slots when the second member is angled from the first member.

BRIEF DESCRIPTION OF THE DRAWINGS

The features of the present invention which are believed to be novel are described in detail hereinbelow. The organization and manner of the structure and operation of the invention, together with further objects and advantages thereof, may best be understood by reference to the following description taken in connection with the accompanying drawings wherein like reference numerals identify like elements in which.

DETAILED DESCRIPTION OF THE ILLUSTRATED EMBODIMENTS

Figure 1:
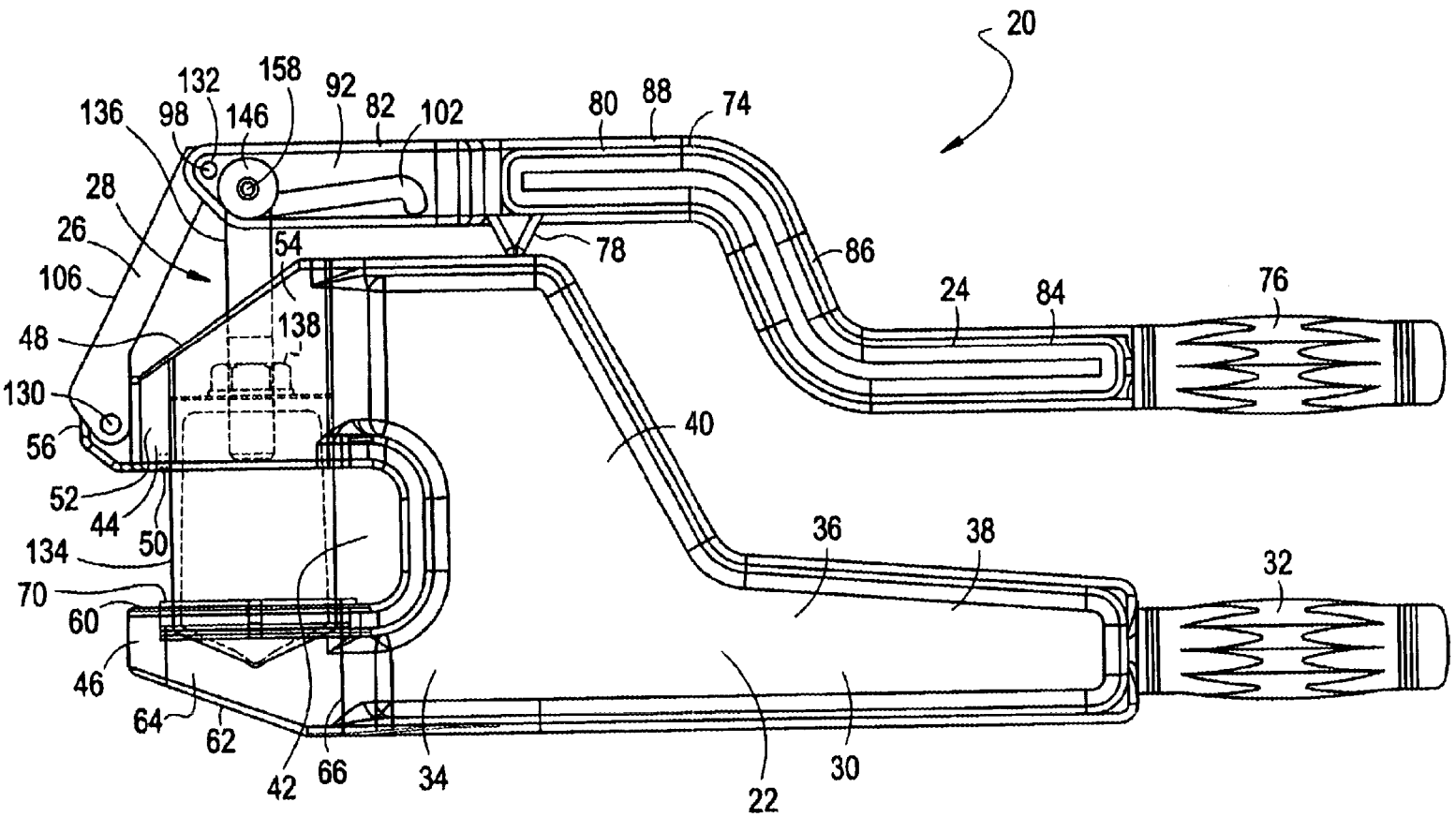
FIG. 1 is a side elevational view of a stud punch tool of the present invention with a punch in a punching position, such punch being shown partially in phantom lines.

While this invention may be susceptible to embodiment in different forms, there is shown in the drawings and will be described herein in detail, a specific embodiment with the understanding that the present disclosure is to be considered an exemplification of the principles of the invention, and is not intended to limit the invention to that as illustrated.

The present invention provides a stud punch tool 20 which generally includes a first member 22, a second member 24, a third member 26 which is pivotally connected to the first member 22 and to the second member 24, and a punch assembly 28.

FIGS. 4–8 illustrate the first member 22 of the stud punch tool 20. The first member 22 is formed of a body portion 30 and an elongated handle portion 32 which is connected to a first end of the body portion 30. It should be noted that the handle portion 32 can be formed as a separate component than the body portion 30 and attached thereto or can be integrally formed with the body portion 30. The handle portion 32 preferably has a material thereon that facilitates the gripping of the handle portion 32 by a user's hand.

The body portion 30 includes a head portion 34 at a second end thereof and an elongated portion 36 that is integrally formed with the head portion 34 and extends from the head portion 34 to the handle portion 32. The portion 36 has a thickness along its outer edges that is generally comparable to a thickness of the handle portion 32. Proximate to the connection of the handle portion 32 and the portion 36, the portion 36 has a section 38 which has a height which is larger than a height of the handle portion 32. The portion 36 also has a section 40 which is distant from the handle portion 32, but proximate to the head portion 34, and which has a height that is larger than the height of the section 38. The head portion 34 generally has a height that is comparable to the height of the section 40 which is proximate thereto. The head portion 34 has a thickness that is larger than that of the portion 36 and the handle portion 32.

The head portion 34 has an opening 42 therein defining a first portion 44 and a second portion 46, such that the head portion 34 is generally C-shaped.

Figure 4:
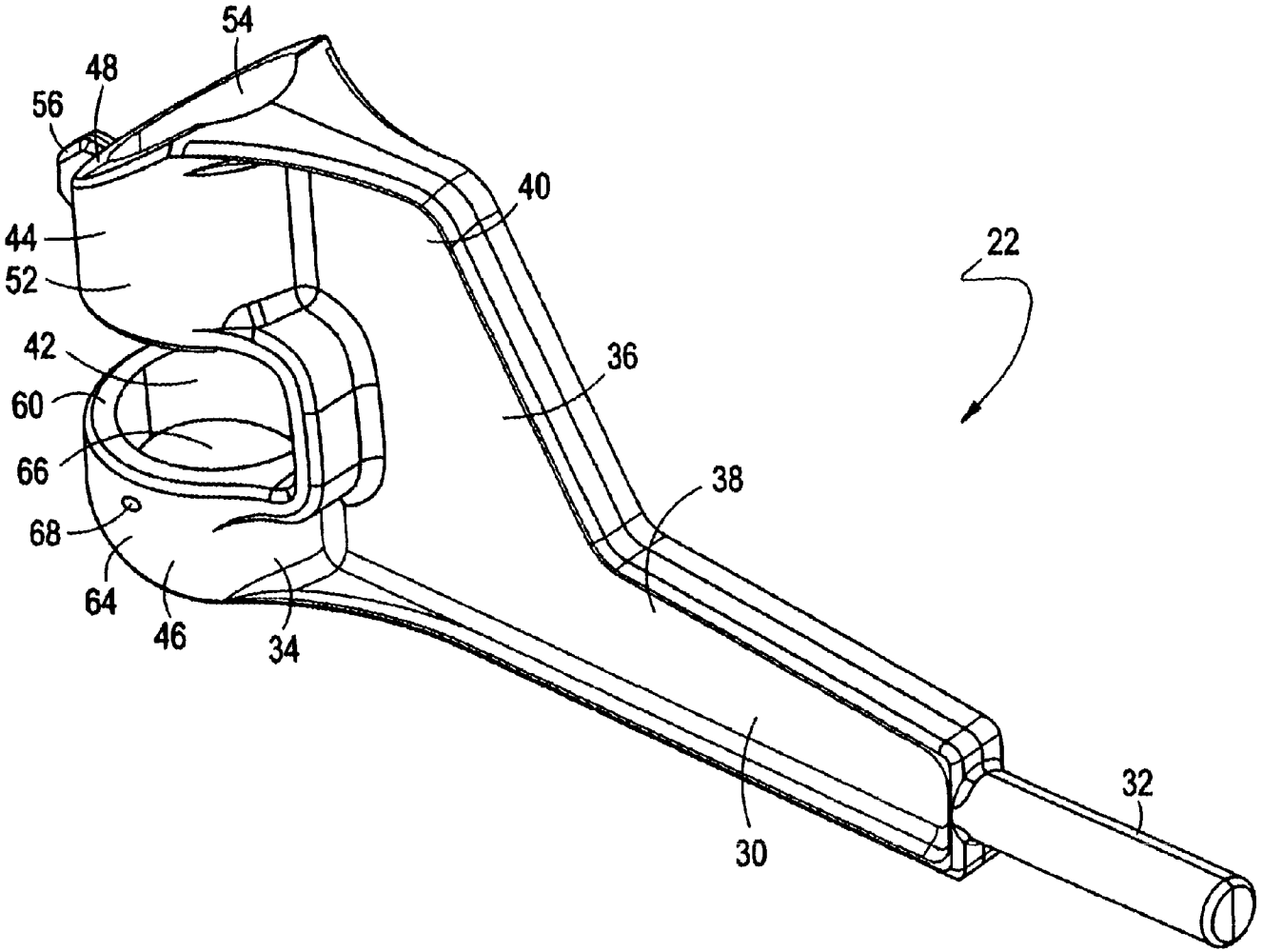
FIG. 4 is a perspective view of a first member of the stud punch tool.
Figure 5:
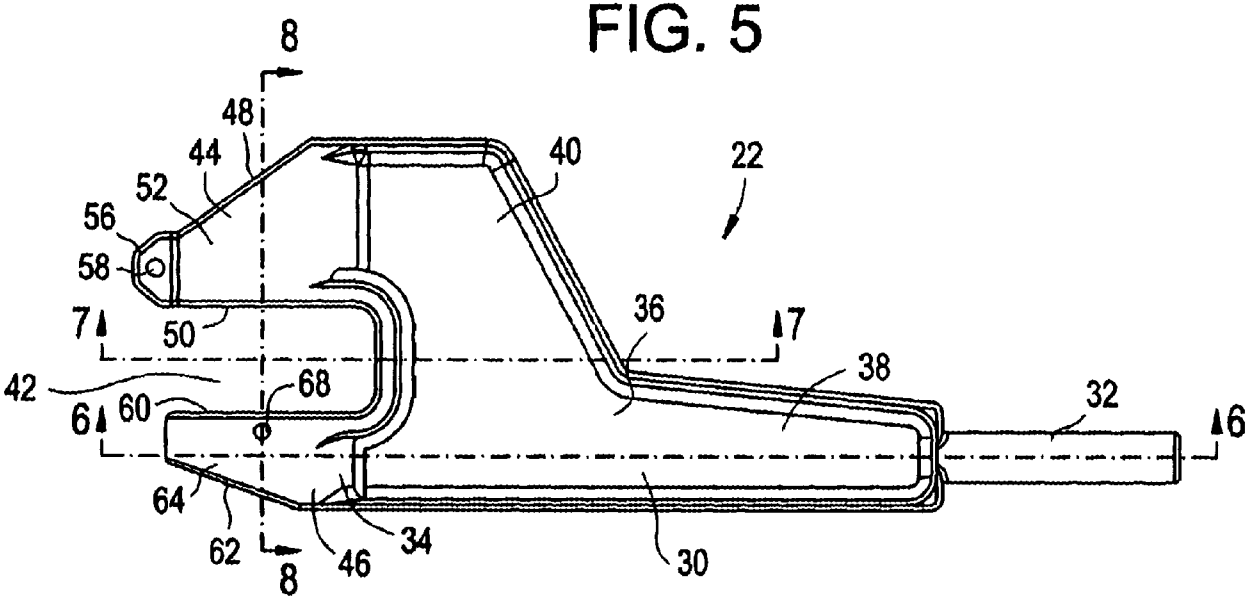
FIG. 5 is a side elevational view of the first member shown in FIG. 4.
Figure 7:
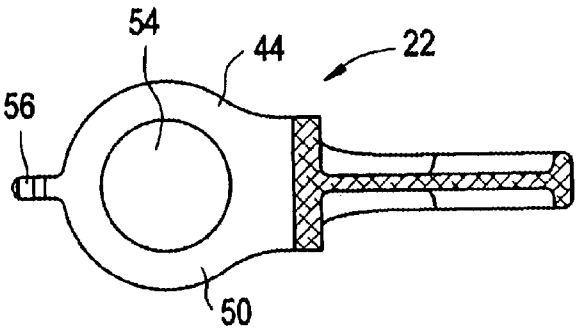
FIG. 7 is a cross-sectional view of the first member taken along line 7—7 of FIG. 5.
Figure 8:
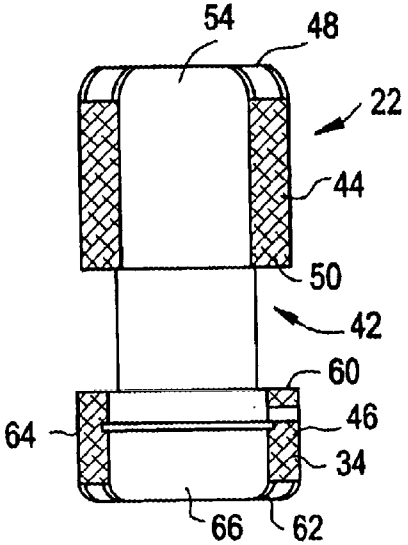
FIG. 8 is a cross-sectional view of the first member taken along line 8—8 of FIG. 5.

The first portion 44 has a top 48, a bottom 50, and a continuous side 52 therebetween. The bottom 50 is proximate to the opening 42 in the head portion 34. The top 48 extends from the second side of the body portion 30 upwardly and at an angle towards the section 40. As best illustrated in FIGS. 4 and 7, the first portion 44 of the head portion 34 has a generally circular cross-section. A generally circular bore 54 extends through the first portion 44 from the top 48 to the bottom 50 such that the bore 54 is in communication with the opening 42 of the head portion 34. The bore 54 is dimensioned such that the punching assembly 28, which will be described in more detail herein, can move therethrough. A flange 56 extends outwardly from the side 52 at the second end of the body portion 30. The flange 56 has an aperture 58 therethrough for allowing the third member 26 to be pivotally connected to the first member 22, as discussed in more detail herein.

Figure 6:
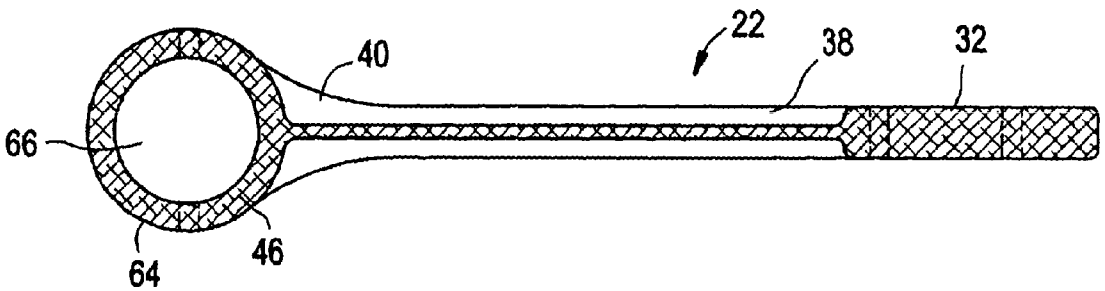
FIG. 6 is a cross-sectional view of the first member taken along line 6—6 of FIG. 5.

The second portion 46 has a top 60, a bottom 62, and a continuous side 64 therebetween. The top 60 is positioned below the opening 42 of the head portion 34. The bottom 62 of the second portion 46 extends from the second side of the body portion 30 downwardly and at an angle towards the section 40. The bottom 50 of the first portion 44 and the top 60 of the second portion 46 are separated by the opening 42. The bottom 50 of the first portion 44 and the top 60 of the second portion 46 are also generally parallel with one another. As best illustrated in FIGS. 4 and 6, the second portion 46 of the head portion 34 has a generally circular cross-section. A generally circular bore 66 extends through the second portion 46 from the top 60 to the bottom 62 such that the bore 66 is in communication with the opening 42 of the head portion 34. The bore 66 is dimensioned such that the punching assembly 28, which will be described in more detail herein, can move into the bore 66. The bore 54 and the bore 66 are aligned with each other. An aperture 68 extends through the continuous side 64 and is in communication with the bore 66.

Figure 9:
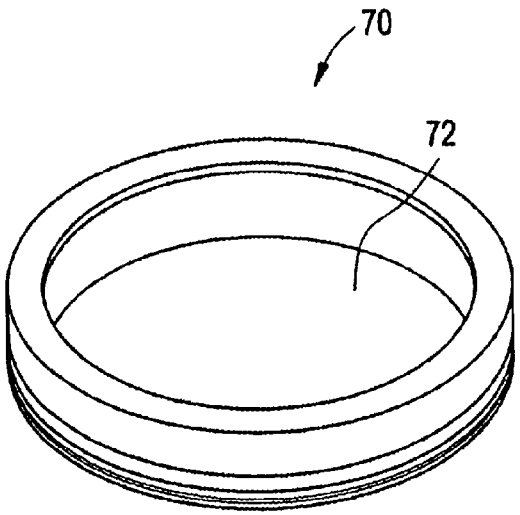
FIG. 9 is a perspective view of a die of the stud punch tool.

A die 70 is positioned within the bore 66 proximate to the top 60 thereof. The die 70 is connected to the second portion 46 of the head portion 34 by suitable means (not shown), such as a screw, which can be inserted through aperture 68 in the second portion 46. As best illustrated in FIG. 9, the die 70 is generally in the form of a cylinder and is sized to fit snugly against the second portion 46 of the head portion 34 within the bore 66. The die 70 has a circular bore 72 therethrough such that the punching assembly 28 can move through the die 70 during the punching process.

Figure 10:
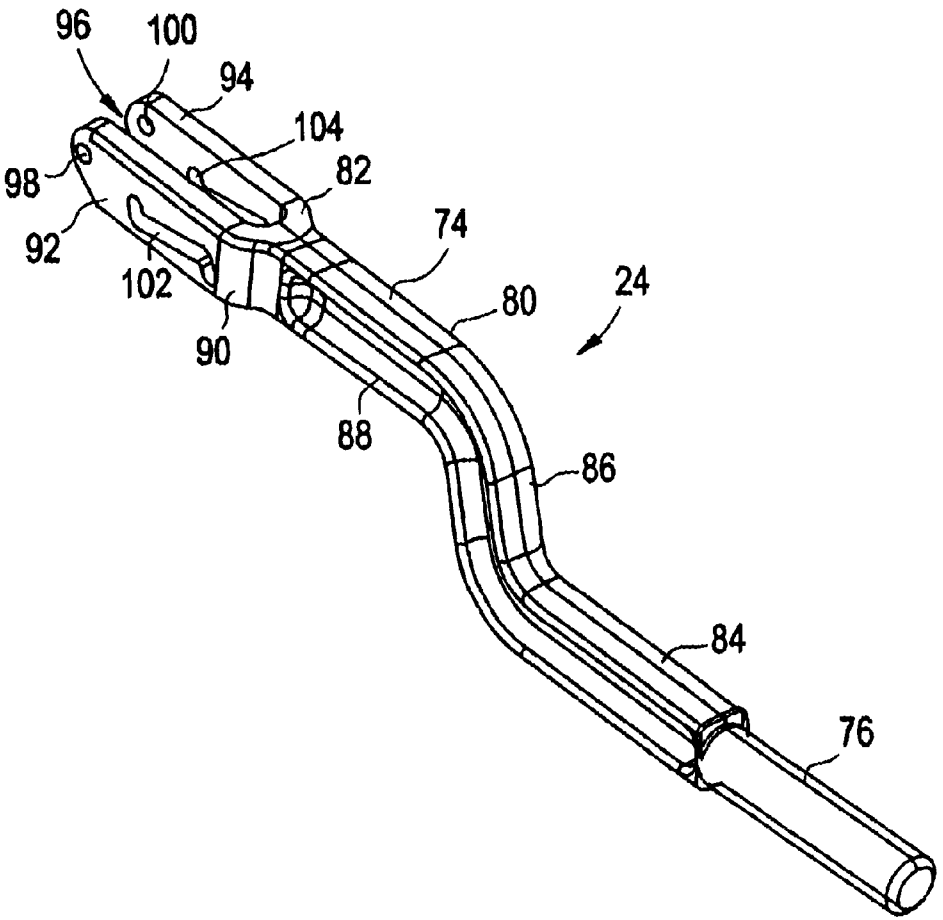
FIG. 10 is a perspective view of a second member of the stud punch tool.
Figure 11:
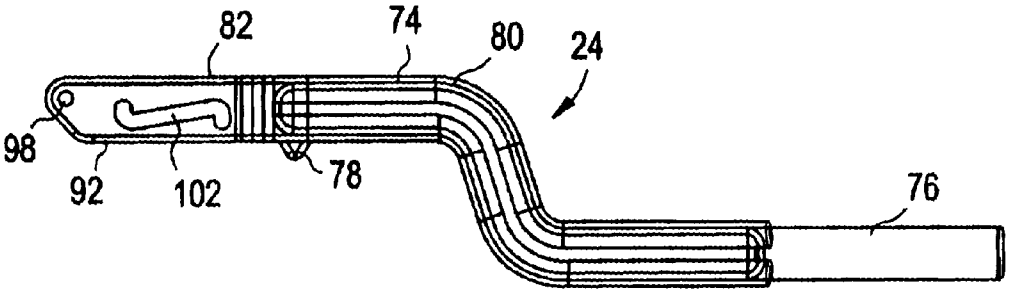
FIG. 11 is a side elevational view of the second member shown in FIG. 10.

FIGS. 10 and 11 illustrate the second member 24 of the stud punch tool 20. The second member 24 has an elongated body portion 74, an elongated handle portion 76 and a stop 78 (see FIG. 11 for the stop 78). The handle portion 76 is connected to a first end of the body portion 74. It should be noted that the handle portion 76 can be formed as a separate component than the body portion 74 and attached thereto or can be integrally formed with the body portion 74. The handle portion 76 preferably has a material thereon that facilitates the gripping of the handle portion 76 by a user's hand.

The body portion 74 has an elongated first portion 80 and a second portion 82. The first portion 80 is connected to the second portion 82 at one end thereof and to the handle portion 76 at the opposite end thereof.

The first portion 80 includes a first section 84, a second section 86, and a third section 88. The first section 84 is connected to the handle portion 76 and the third section 88 is connected to the second portion 82. The first section 84 and the third section 88 are parallel to each other and the second section 86 is curved and provided between the first and third sections 84, 88. This causes the first portion 80 to generally mirror the change in height in the portion 36 of the first member 22 when the handle portion 32 of the first member 22 and the handle portion 76 of the second member 24 are generally parallel to one another as shown in FIG. 1. The first portion 80 has a thickness that is generally comparable to a thickness of the handle portion 76.

The second portion 82 is generally U-shaped and includes a base 90 and a pair of extending sections 92, 94 which are separated by an opening 96. The U-shaped second portion 82 has a thickness that is greater than the thickness of the first portion 80 because of the opening 96. The U-shaped second portion 82 has a height which is comparable to the height of the third section 88. The base 90 connects the second portion 82 to the first portion 80.

Each extending section 92, 94 has an aperture 98, 100 therethrough proximate to a respective end that is opposite to the connection point to the base 90. Each aperture 98, 100 is in communication with the opening 96. The apertures 98, 100 are also in axial alignment with one another. The apertures 98, 100 allow the third member 26 to be pivotally connected to the second member 24, as is discussed in more detail herein.

Each extending section 92, 94 further includes an elongated slot 102, 104 therein. The slots 102, 104 are positioned in the extending sections 92, 94 between the apertures 98, 100 and the base 90 of the U-shaped second portion 82. Each slot 102, 104 is in communication with the opening 96. The slots 102, 104 are also in axial alignment with one another and are generally S-shaped. The slots 102, 104 allow for the attachment, and the movement, of the punching assembly 28 relative to the second member 24, the structure and operation of which will be described herein in further detail.

The stop 78, see FIG. 11, of the second member 24 is located on a bottom side of the third section 88 of the first portion 80 proximate to the connection of the first portion 80 and the second portion 82 and extends therefrom. The use of the stop 78 will be discussed with regard to the operation of the stud punch tool 20 herein.

Figure 12:
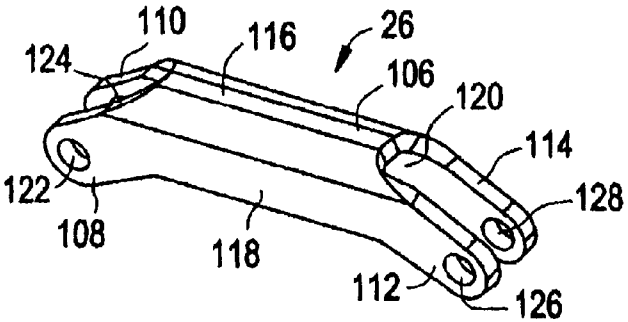
FIG. 12 is a perspective view of a third member of the stud punch tool.

Attention is now directed to FIG. 12 and the third member 26 of the stud punch tool 20. The third member 26 is formed of an elongated U-shaped portion 106 having a first pair of extending portions 108, 110 extending from one end thereof and a second pair of extending portions 112, 114 extending from an opposite end thereof. The U-shaped portion 106 has a generally curved base portion 116, a straight portion 118 extending from one end of the base portion 116 and a straight portion 120 extending from the other end of the base portion 116. The straight portions 118, 120 are parallel to one another.

Extending portion 108 extends from one end of straight portion 118 and is angled relative to straight portion 118. Extending portion 108 has an aperture 122 therethrough at its free end. Extending portion 110 extends from one end of straight portion 120 and is angled relative to straight portion 120. Extending portion 110 has an aperture 124 therethrough at its free end. Extending portions 108, 110 are parallel to each other and angled relative to the respective straight portions 118, 120 at the same angle such that aperture 122 and aperture 124 are in axially alignment with one another.

Extending portion 112 extends from an opposite end of straight portion 118 than does extending portion 108 and is angled relative to straight portion 118. Extending portion 112 has an aperture 126 therethrough at its free end. Extending portion 114 extends from an opposite end of straight portion 120 than does extending portion 110 and is angled relative to straight portion 120. Extending portion 114 has an aperture 128 therethrough at its free end. Extending portions 112, 114 are parallel to each other and angled relative to the respective straight portions 118, 120 at the same angle such that aperture 126 and aperture 128 are in axially alignment with one another.

The extending portions 108, 110 are positioned around the flange 56 of the first member 22 such that the apertures 122, 124 are in axial alignment and communication with the aperture 58 of the flange 56. A connector 130, such as a pin, is inserted through the apertures 122, 58, 124 to secure the flange 56 and the extending portions 108, 110 together while still allowing the rotation of the third member 26 and the first member 22 with respect to one another.

The extending portions 112, 114 are positioned within the opening 96 of the U-shaped second portion 82 of the second member 24 between the extending sections 92, 94 such that the apertures 126, 128 of the extending portions 112, 114 are in axial alignment and communication with the apertures 98, 100 of the extending sections 92, 94 of the second portion 82 of the second member 24. A connector 132, such as a pin, is inserted through the apertures 98, 124, 126, 100 to secure the extending sections 92, 94 and the extending portions 112, 114 together while still allowing the rotation of the third member 26 and the second member 24 with respect to one another.

Figure 2:
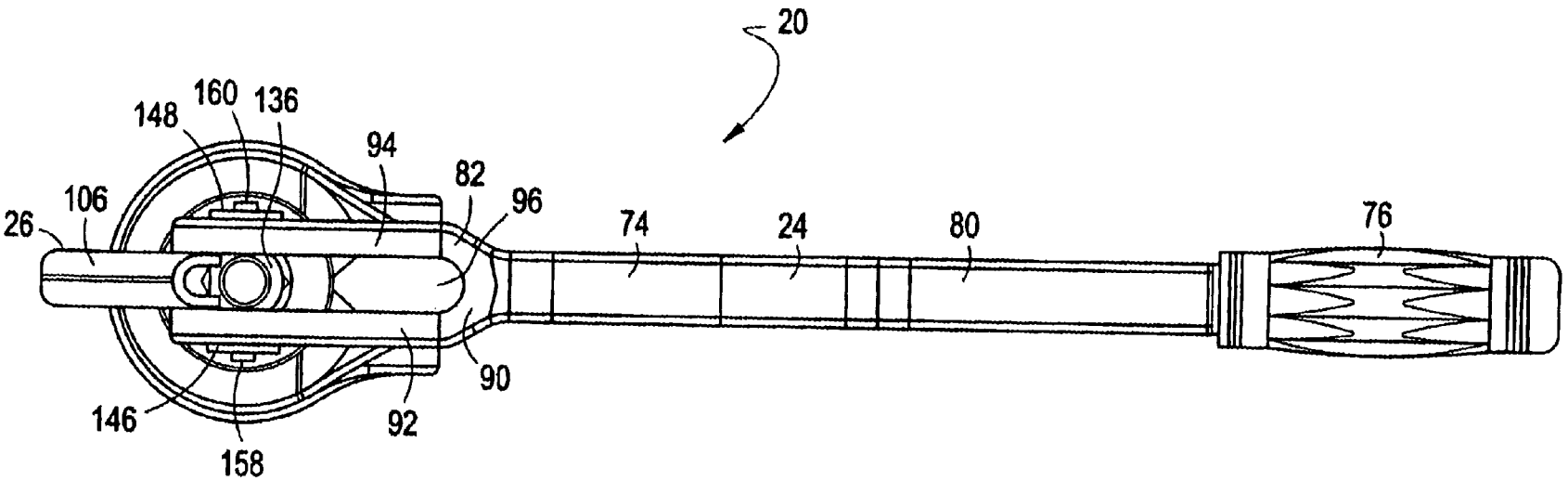
FIG. 2 is a top plan view of the stud punch tool shown in FIG. 1.
Figure 3:
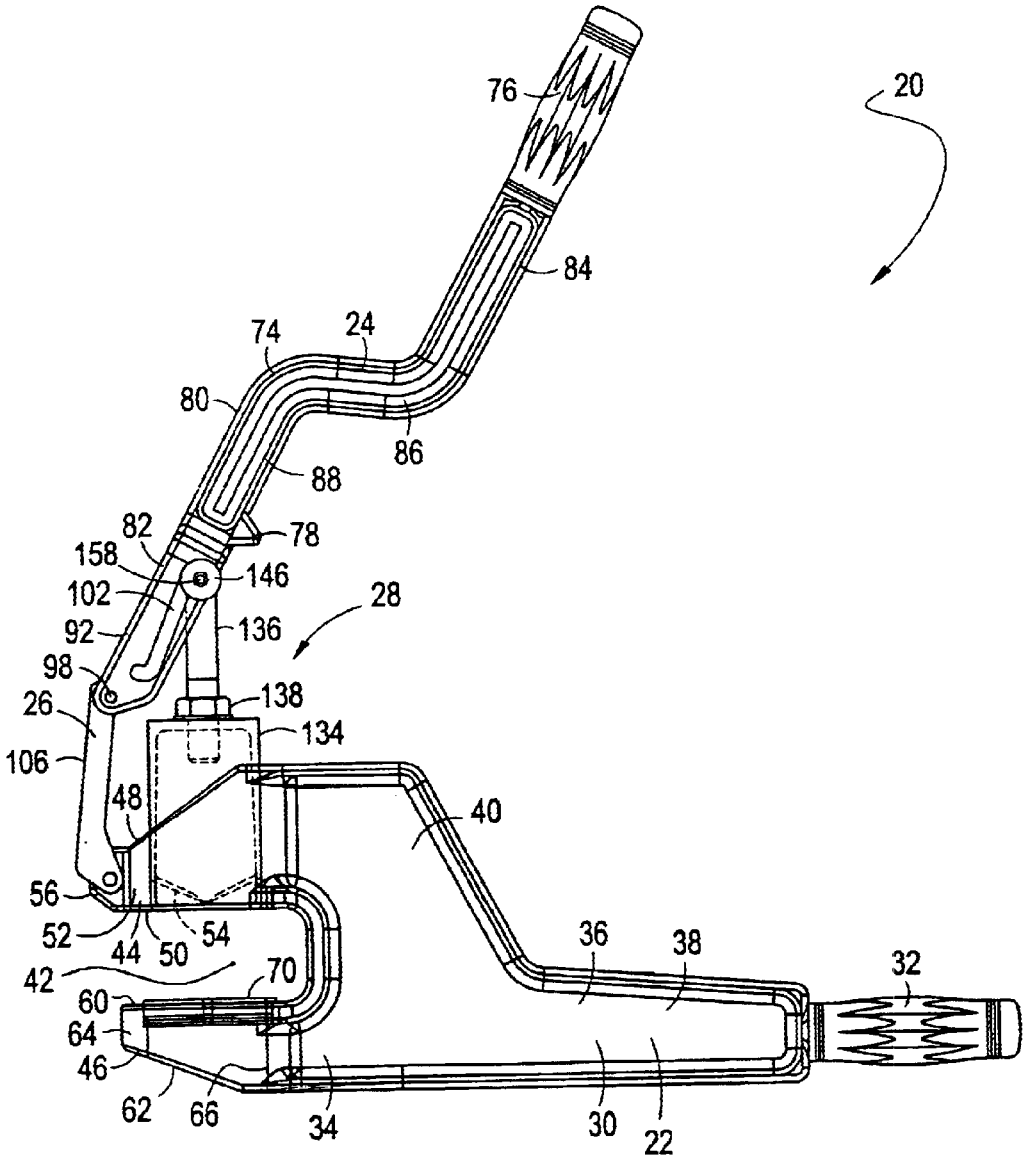
FIG. 3 is a side elevational view of the stud punch tool with the punch in a non-punching position, such punch being shown partially in phantom lines.

FIGS. 1–3 illustrate the punching assembly 28 of the stud punch tool 20. The punching assembly 28 includes a punch 134 and a punch shaft 136 connected at a first end thereof to a first end of the punch 134 by suitable connection means 138.

The punch 134 and the connection means 138 are conventional and as such, the details of the punch 134 and the connection means 138 are not described herein. The punch 134 is used for cutting/punching a steel stud (not shown) and has an edge formed for such purpose. The punch 134 has a diameter that is slightly less than that of the circular bore 72 in the die 70 mounted in the head portion 34 and of the bores 54, 56 provided in the head portion 34 such that the punch 134 can move through the bores 54, 66 and the die 70 during the punching process. It should be noted that the die 70 can be removed from the head portion 34 such that dies having different sized bores therethrough can be attached within the bore 66. Similarly, the punch 134 can be removed and replaced with punches having different diameters that will allow the punch to move through the die should the die be changed. Such removability and replaceability of the die 70 and punch 134 allows a user to use the stud punch tool 20 to punch a plurality of different sized holes and to replace a die and punch should they become worn.

The punch shaft 136 is an elongated solid cylinder. An aperture (not shown) extends through the punch shaft 136 proximate to a second end thereof, which is opposite to the first end.

Figure 13:
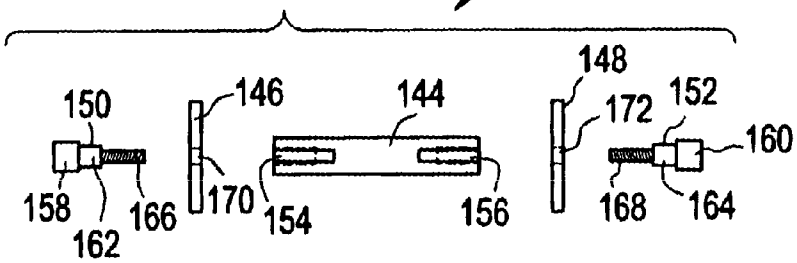
FIG. 13 is an exploded, side, elevational view of the assembly for connecting the punch shaft to the second member.

The second end of the punch shaft 136 is connected to the second member 24 by a connection assembly 142, see FIG. 13. The second end of the punch shaft 136 is positioned within the opening 96 between the U-shaped second portion 82 such that the aperture of the punch shaft 136 is in axial alignment with a portion of the elongated slots 102, 104 of the U-shaped second portion 82.

The connection assembly 142 includes a connector 144, a pair of washers 146, 148 and a pair of screws 150, 152. The connector 144, such as a standoff, has openings 154, 156 in both of its ends that are internally threaded. Each screw, 150, 152 includes a head 158, 160 having an unthreaded portion 162, 164 extending therefrom which has a threaded portion 166, 168 extending from the unthreaded portion 162, 164. Each washer 146, 148 has an aperture 170, 172 therethrough which has a diameter equal to the diameter of the unthreaded portion 162, 164 of the respective screw 150, 152.

To connect the punch assembly 28 to the second member 24, the connector 144 is inserted through the aperture 140 of the second end of the punch shaft 136. The second end of the punch shaft 136 is then positioned between the slot 102 of the extending portion 92 and the slot 104 of the extending portion 94. The screws 150, 152 are placed through the apertures 170, 172 of washers 146, 148 such that a first side of the washers 146, 148 abuts against the heads 158, 160 of the respective screws 150, 152 and are positioned around the unthreaded portions 162, 164 of the screws 150, 152. The screws 150, 152 are then placed through the slots 102, 104 of the extending sections 92, 94 and into the openings 154, 156 of the connector 144. The threaded portions 166, 168 of the screws 150, 152 are threaded into the openings 154, 156 of the connector 144. The unthreaded portions 162, 164 of the screws 150, 152 are positioned within the slots 102, 104, such that the unthreaded portions 162, 164 of the screws 150, 152 can slide within the slots 102, 104. A second side of the washers 146, 148 abuts against the outside of the respective extending sections 92, 94. The connection assembly 142 connects the punching assembly 28 to the second member 24.

An operation of the stud punch tool 20 of the present invention will now be discussed. The user uses the stud punch tool 20 of the present invention to punch a hole in, for instance, a steel stud or a piece of sheet metal to allow the user to run PVC pipe therethrough.

The user moves the second member 24 to a position as shown in FIG. 3 by a pulling action, where the handle portion 76 of the second member 24 is not parallel to the handle portion 32 of the first member 22. By positioning the second member 24 in this position, the first end of the punch shaft 136 is moved to the first end of the S-shaped slots 102, 104 of the second portion 82 of the second member 24. Because the first end of the punch shaft 136 is positioned at the first end of the S-shaped slots 102, 104, the punch 134 is positioned within the bore 54 of the first portion 44 of the head portion 34. As the punch 134 is not positioned within the opening 42 of the head portion 34, the user can position the steel stud or piece of sheet metal to be punched within the opening 42 of the head portion 34 and rest it on the die 70.

When the steel stud or piece of sheet metal is properly positioned on the die 70 within the opening 42 of the head portion 34, the user grips the handle portions 32, 76 of both the first and second members 22, 24. The user then pushes the second member 24 toward the first member 22 until the stop 78 on the second member 24 abuts against the first member 22 when the two members 22, 24 are generally parallel to one another, as illustrated in FIG. 1.

By moving the second member 24 toward the first member 22, the third member 26 pivots relative to the first member 22 and to the second member 24. In addition, the second end of the punch shaft 136 slides within the S-shaped slots 102, 104 from the first end of the slots 102, 104 to the second end of the slots 102, 104. As the second end of the punch shaft 136 is moving from the first end of the slots 102, 104 to the second end of the slots 102, 104 due to the force being applied to the second member 24, the first end of the punch shaft 136 causes the punch 134 to move through the bore 54 of the first portion 44 of the head portion 34 and into the opening 42 of the head portion 34. The edge of the punch 134 comes into contact with the steel stud or piece of sheet metal in the opening 42 of the head portion 34 and the punch 134 punches through the steel stud or piece of sheet metal with the assistance of the die 70 helping to shear the steel stud or piece of sheet metal in conjunction with the punch 134. The material of the steel stud or piece of sheet metal that is punched is then forced through the die 70 and the bore 66 of the second portion 46 by the punch 134 as it continues to move through the die 70 and the bore 54 of the second portion 46. The material is expelled through the bore 66 of the second portion 46.

After the hole is punched in the steel stud or piece of sheet metal, the user moves the second member 24 from its position as shown in FIG. 1 back to a position as shown in FIG. 3 by pulling the second member 24 away from the first member 22. By moving the second member 24 back to this position, the third member 26 pivots relative to the first member 22 and the second member 24. In addition, the second end of the punch shaft 136 slides from the second end of the slots 102, 104 to the first end of the slots 102, 104. This movement in turn causes the punch 134 to move out of the bore 66 of the second portion 46, through the opening 42 of the head portion 34 and into the bore 54 of the first portion 44. After the punch 134 is removed from the opening 42, the user is free to remove the tool 20 from the steel stud or piece of sheet metal. The steel stud or piece of sheet metal then has a hole punched therethrough such that the user can insert PVC pipe therein.

The slots 102, 104 in the second portion 82 of the second member 24 create a mechanical advantage as the punch shaft 136 and the third member 26 are close together. The movement of the punch shaft 136 from one end of the slots 102, 104 to punch a hole, to the other end of the slots 102, 104 to lift the punch 134 clear of the stud, is a simple push or pull of the second member 24. The elongated slots 102, 104 further help keep the handle force low to punch the hole, but also provides enough travel so that the punch 134 can clear the stud, thus allowing the tool 20 to be easily placed on and off the stud. Also, because the pivot points are close together, the amount of force required to actuate the second member 24 is minimized.

It should be noted that the second portion 82 of the second member 24 need not be U-shaped, but rather could have a single extending portion having a single slot therethrough for connection of the punching assembly 28 and a single aperture therethrough for pivotal connection of the third member 26. Should such a design be used, changes in the design of the punch shaft 136 would have to be made. The second end of the punch shaft 136 would have to have two extending portions having apertures therethrough such that the extending portions would extend around the single extending portion of the second portion of the second member. Each extending portion of the redesigned punch shaft would also have to have an aperture therethrough to allow for the connection of the extending portions to the second member through the slot of the second portion, all the while allowing the punch shaft to move from one end of the slot to another end of the slot. Such connections, while not described herein, would be obvious to one of ordinary skill in the art after a reading of the present disclosure.

It should further be noted that reference to tops, bottoms, sides, etc. as different parts of the invention are made for reference purposes only as the stud punch tool 20 does not necessarily have to be used in the manner shown in the illustrations, i.e., the stud punch tool 20 could be used by a user with the first and second members 22, 24 being parallel to the ground.

While a preferred embodiment of the present invention is shown and described, it is envisioned that those skilled in the art may devise various modifications without departing from the spirit and scope of the foregoing description.

The invention is claimed as follows:

1. A stud punch tool for punching a stud, comprising:

a first member having first and second ends and an opening therein for receiving the stud, said first member further having a bore therethrough proximate to said first end thereof which is in communication with said opening;

a second member having first and second ends and at least one elongated slot therein proximate to said first end thereof;

a third member pivotally connected to said first end of said first member and pivotally connected to said first end of said second member; and a punch assembly, said punch assembly being slidable within said at least one slot of said second member, said punch assembly further being capable of moving through said bore and said opening of said first member for punching said stud.

2. A stud punch tool as defined in claim 1, wherein said punch assembly includes a punch shaft having opposite ends and a punch connected to one said end of said punch shaft and said opposite end of said punch shaft being slidably mounted within said at least one slot of said second member.

3. A stud punch tool as defined in claim 2, wherein said punch is sized to move through said bore of said first member.

4. A stud punch tool as defined in claim 1, wherein said opening in said first member defines a C-shaped head of said first member such that said opening is positioned between a first portion of said C-shaped head and a second portion of said C-shaped head.

5. A stud punch tool as defined in claim 4, wherein said bore of said first member extends through said first portion of said C-shaped head and into said second portion of said C-shaped head.

6. A stud punch tool as defined in claim 1, wherein said opening is provided at said first end of said first member and a handle portion is provided at said second end of said first member.

7. A stud punch tool for punching a stud, comprising:

a first member having an opening therein for receiving the stud, said first member further having a bore therethrough in communication with said opening;

a second member having at lease one elongated slot therein and opposite ends, said at least one slot being provided in one said end and a handle portion being provided at said opposite end;

a third member pivotally connected to said first member and pivotally connected to said second member; and a punch assembly, said punch assembly being slidable within said at least one slot of said second member, said punch assembly further being capable of moving through said bore and said opening of said first member for punching said stud.

8. A stud punch tool for punching a stud, comprising:

a first member having an opening therein for receiving the stud, said first member further having a bore therethrough in communication with said opening;

a second member having at least one elongated slot therein, said at least one slot being generally S-shaped;

a third member pivotally connected to said first member and pivotally connected to said second member; and a punch assembly, said punch assembly being slidable within said at least one slot of said second member, said punch assembly further being capable of moving through said bore and said opening of said first member for punching said stud.

9. A stud punch tool comprising:

means for receiving a stud, wherein said receiving means has first and second opposite ends;

means for punching the stud;

means for moving said punching means, wherein said moving means has first and second opposite ends, said moving means comprises a member having at least one elongated slot therein and wherein a portion of said punching means is mounted in said at least one slot to slide from one end of said at least one slot to an opposite end of said at least one slot; and means for pivotally linking said receiving means at said first end thereof to said moving means at said first end thereof, said punching means being positioned between said first and second ends of said receiving means and between said first and second ends of said moving means.

10. A stud punch tool comprising:

means for receiving a stud;

means for punching the stud;

means for moving said punching means from a first position to a second position, said moving means comprising a member having at least one elongated slot therein, said at least one slot being generally S-shaped, a portion of said punching means being mounted in said at least one slot to slide from one end of said at least one slot to an opposite end of said at least one slot;

means for pivotally linking said receiving means to said moving means.

11. A stud punch tool comprising:

means for receiving a stud;

means for punching a stud;

means for moving said punching means from a first position to a second position, said moving means comprising a member having at least one elongated slot therein, an end of said member having a handle portion, a portion of said punching means being mounted in said at least one slot to slide from one end of said at least one slot to an opposite end of said at least one slot;

means for pivotally linking said receiving means to said moving means.

12. A stud punch tool comprising:

means for receiving a stud, wherein said receiving means has first and second opposite ends, said receiving means comprises a member having a first portion and a second portion extending from an end of said member, said first portion and said second portion defining an opening therebetween for receiving the stud, said receiving means has a bore therethrough that extends through said first portion and into said second portion;

means for punching the stud, said punching means being capable of traveling through said vertical bore;

means for moving said punching means, wherein said moving means has first and second opposite ends; and means for pivotally linking said receiving means at said first end thereof to said moving means at said first end thereof, said punching means being positioned between said first and second ends of said receiving means and between said first and second ends of said moving means.

13. A stud punch tool for punching a stud, comprising:

a first member having opposite ends, said first member having a handle portion at one end thereof and a head portion at an opposite end for receiving the stud, said head portion including a first portion and a second portion having an opening defined therebetween, said first member further having a bore extending through said first portion and said second portion of said head portion, said bore being in communication with said opening;

a second member having a first end and a second end, said second member having a handle portion at said first end thereof and at least one S-shaped elongated slot at said second end thereof;

a third member having a first end and a second end, said first end of said third member being pivotally connected to said first member, said second end of said third member being pivotally connected to said second end of said second member;

a punch assembly including a punch shaft and a punch, said punch shaft having a first end and a second end, said first end of said punch being slidably connected to said second end of said second member through said at least one S-shaped elongated slot, said second end of said punch shaft being connected to said punch, said punch being sized to move through said bore of said first member.

* * * * *